United States Patent [19]

Henderson

[11] 3,969,780

[45] *July 20, 1976

[54] CONTINUOUS CARPET DYEING PROCESS

[76] Inventor: James M. Henderson, P.O. Box 773, Dalton, Ga. 30720

[ * ] Notice: The portion of the term of this patent subsequent to July 20, 1991, has been disclaimed.

[22] Filed: May 4, 1972

[21] Appl. No.: 250,298

[52] U.S. Cl. ..... 8/149.1; 8/149.3; 8/151; 26/2 R; 68/205 R; 118/50; 118/410; 118/412; 118/415; 427/373; 428/96; 428/310

[51] Int. Cl.[2] ..... D06B 1/02

[58] Field of Search ..... 8/149.1, 149.2, 149.3, 8/151; 68/205 R; 118/415, 412, 410, 50; 26/2 R; 427/373; 428/96, 310

[56] References Cited

UNITED STATES PATENTS

| | | | |
|---|---|---|---|
| 2,393,502 | 1/1946 | Groncy | 118/415 |
| 2,464,849 | 3/1949 | Coward | 118/415 |
| 3,030,232 | 4/1962 | Morgenstern | 117/119.6 |
| 3,032,828 | 5/1962 | Bethe et al. | 117/119.6 |
| 3,085,896 | 4/1963 | Britt et al. | 117/119.6 X |
| 3,271,102 | 9/1966 | Morgan | 68/205 R X |

*Primary Examiner*—Philip R. Coe
*Attorney, Agent, or Firm*—Jones, Thomas & Askew

[57] ABSTRACT

A continuous dyeing process for use in dyeing material, such as carpet, a selected one of a number of colors. The process is performed by providing at least two dye applicator means, advancing a length of material to be dyed along a predetermined path adjacent the applicator means, operating one of the applicator means a predetermined period of time to apply one color dye to the length of material moving along the predetermined path, fixing the first color dye to the length of material, operating the other one of the dye applicator means for a predetermined period of time to apply a second color dye to a length of material moving along the predetermined path, and fixing the second color dye to the length of material. The dye is applied in a foam mixture having predetermined amounts of dye material, predetermined amounts of a thickening material, predetermined amounts of water and predetermined amounts of air processed in a mixing apparatus to develop a foam mixture. The foam mixture containing dye is applied only to one surface of material moving along a predetermined path by either extruding the foam material onto the length of material being dyed, creating a puddle of the foam material on the length of material and doctoring the foam material to a predetermined height, or by introducing the foam dye material into a container applicator means having an edge operable for doctoring the foam material to a predetermined height.

19 Claims, 5 Drawing Figures

CONTINUOUS CARPET DYEING PROCESS

BACKGROUND OF THE INVENTION

This invention relates to a continuous process of dyeing carpet and is more particularly concerned with a process for selectively dyeing a carpet any one of a number of colors.

One prior art continuous dyeing process is performed by advancing material to be dyed along a predetermined path through a vat containing liquid dye material, with the material leaving the vat, then being advanced through a steam oven for fixing the dye to the material. Another prior art carpet dyeing process is performed by lowering a batch of carpet in a vat containing dye and then transferring the carpet to a steam oven for fixation.

In the vat applicator process, when the dyeing apparatus is being changed for applying a second color of dye material, the complete dyeing process must be stopped, the vat and dye applicator means must be thoroughly cleaned before a second color dyeing process can be started.

The above disadvantages of the vat dye applicator process increased the cost of dyeing carpet since the complete dyeing line must be shut down during the change-over from one color dye to a second color dye. Further, due to the extreme cost of changing from one color dye to a second color dye, it is not economically feasible to dye short runs or small amounts of carpet.

SUMMARY OF THE INVENTION

The above disadvantages have been overcome by the present invention which basically includes a process for applyimg a foam mixture containing dye material to the length of material being dyed, with the length of material being advanced through a steam over for fixing the dye material to the carpet.

One important feature of the present invention is that the foam mixture containing dye material is applied only to the pile or nap surface of the carpet with the applicator means being easily changed for using a second color dye material.

In using the continuous dyeing process of the present invention for dyeing a length of carpet a number of colors, two dye applicator means are provided, with a dye applicator means being easily moved from a position adjacent the upper surface of the carpet moving along the predetermined path to an adjusted position located remotely from the carpet for cleaning. One of the dye applicator means is cleaned while the second dye applicator means is applying a second color to the length of material moving along the predetermined path thus allowing the remaining apparatus associated with a carpet dyeing process to continue to run without a long period of shutdown.

A further important feature of the present invention is that by providing means for applying a foam mixture containing dye material through a number of applicator means, with the applicator means being selectively operable, a short run of carpet can be economically dyed thus offering a much more diversified color combination of carpet material.

It is therefore a primary object of the present invention to provide a continuous dyeing process for use in dyeing carpet a selected one of a number of colors.

An additional object of the present invention is to provide a process for use in dyeing carpet a selected one of a number of colors which is simple in operation, economical to use and reliable in performance.

These and other objects and advantages of the details of construction will become apparent after reading the following description of the illustrative embodiments with reference to the attached drawings wherein like reference numerals have been used to refer to like parts throughout the several figures and wherein:

DESCRIPTION OF THE ILLUSTRATIVE EMBODIMENTS

Figure 1:
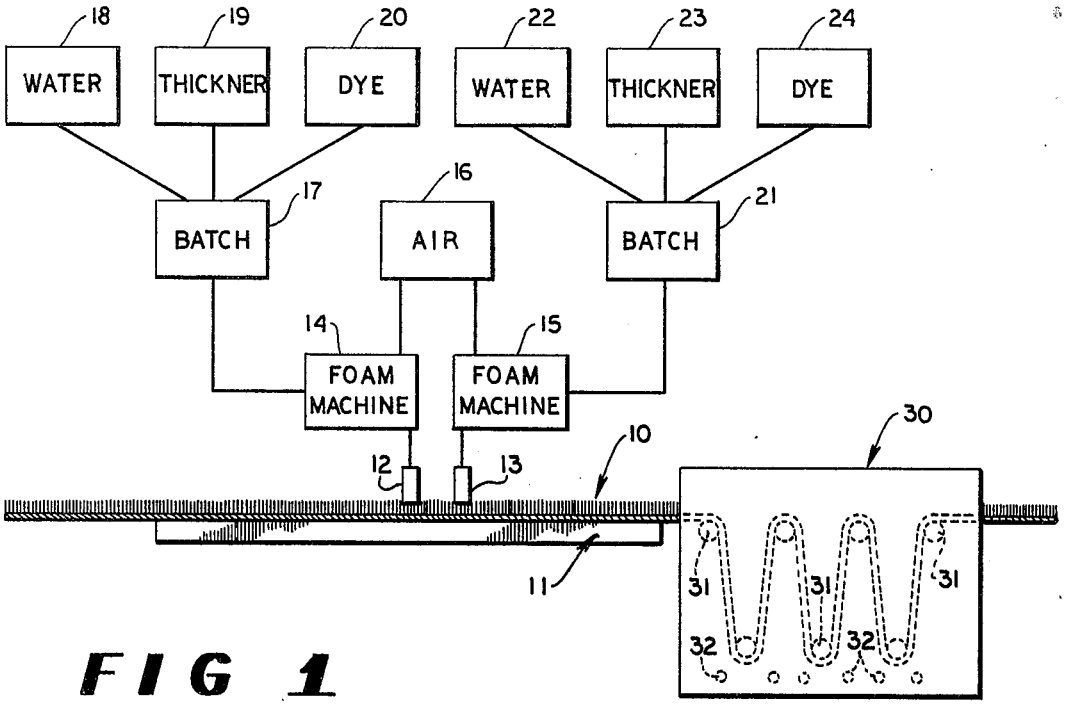
FIG. 1 is a schematic view of a carpet dyeing process emboodying the principles of the present invention.

Referring to the drawing, the continuous carpet dyeing process of the present invention will be described with reference to the apparatus required to carry out the process, including alternate applicator means and arrangements, followed by the description of the steps of the process.

As shown in FIG. 1, a length of carpet to be dyed is generally represented by the reference numeral 10 and is conveyed along a predetermined path by conventional carpet conveying apparatus (not shown). Carpet support means 11 is positioned beneath carpet 10 with a pair of foam mixture dye applicators 12, 13 supported above carpet 10. A foam mixture containing carpet dye is supplied to applicators 12, 13 by conventional individual foam machines 14, 15, respectively. Foam machines 14 and 15 are independently operable, with both of the foam machines being connected to a common air supply means 16 which is used in developing a foam mixture. Foam machine 14 is supplied with a mixture of material from batch means 17. Batch means 17 contains a mixture of predetermined amounts of water, powder or liquid thickner material, such as gum tragacanth and selected color dye material supplied from supply sources 18, 19 and 20, respectively.

Foam machine 15 is supplied with a mixture of material from batch means 21, which contains a mixture of predetermined amounts of water, thickner material and another selected color dye material. Batch means 21 is supplied from a water source 22, thickner material source 23 and dye material source 24.

As shown in FIG. 1, the carpet material 10 being advanced along the predetermined path beneath applicators 12, 13 and above support 11 is then advanced through a conventional steam oven 30. Carpet 10 is guided through oven 30 by a plurality of roller guide means 31, with over 30 including a steam supply source 32 operable for developing sufficieint temperature and moisture conditions to cause fixation of dye material contained in a foam mixture to the carpet pile or nap.

Figure 2:
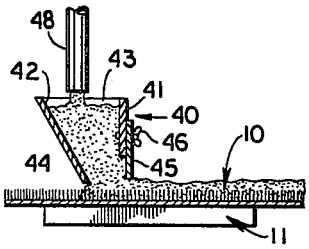
FIG. 2 is an elevational schematic view of one applicator means.

The applicators 12, 13 can be constructed in a number of embodiments. One embodiment of an applicator is shown in FIG. 2 and generally represented by number 40. Applicator 40 includes an elongated tray or container having a longitudinal dimension equal to the width of the carpet being dyed. The applicator tray is provided with a vertical side wall 41 and a sloping wall 42 and includes a pair of end walls (not shown). Applicator 40 has a top entrance opening 43 and a bottom discharge opening 44. Vertical wall 41 includes an adjustable bottom edge 45 adjacent discharge opening 44. Adjustable edge 45 is adapted to be held in a selected adjusted position by conventional locking screw means 46 so that the height or amount of foam mixture being applied to carpet 10 can be varied. The foam mixture containing dye is supplied to applicator tray 40 through conduit 48. In operation, the foam mixture containing dye is supplied through conduit 48 from one of the foam machines 14, 15 in a sufficient amount and in a matter to reach a predetermined height in the applicator tray. As carpet 10 is advanced beneath applicator 40 the foam mixture containing dye will be applied to the upper or the pile surface of the carpet. The amount of foam mixture will be controlled by adjustable edge 45, with edge 45 being operable to doctor the foam mixture evenly across the width of the carpet and evenly along the length of the carpet.

Figure 3:
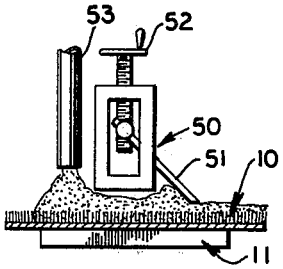
FIG. 3 is an elevational schematic view of a second applicator means.
Figure 4:
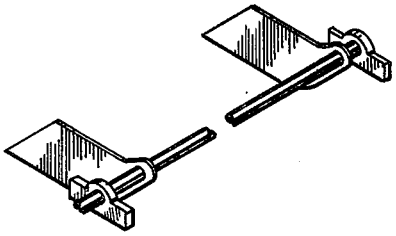
FIG. 4 is an horizontal schematic view showing material confining means.

FIG. 3 shows a second embodiment of a foam mixture applicator which is generally represented by number 50. Applicator 50 includes an elongated doctoring blade 51 supported across the width of carpet 10. Blade 51 is adjustably supported adjacent its opposite ends by a crank and threaded screw adjustment mechanism 52. A foam mixture is supplied from one of the foam machines 14, 15 through conduit means 53 which discharges the foam mixture on the upper carpet surface. Conduit means 53 is supported by conventional carriage means (not shown) for reciprocating movement across the width of the carpet to form a puddle of the foam mixture on the carpet with the puddle being doctored to a predetermined height by doctoring blade 51 during advancement of the carpet beneath blade 51. The puddle of the foam mixture is confined to the width of the carpet by lateral confining blade 55, 56. Blades 55, 56 can be adjusted by a conventional threaded shaft support means to accommodate various width carpet.

Figure 5:
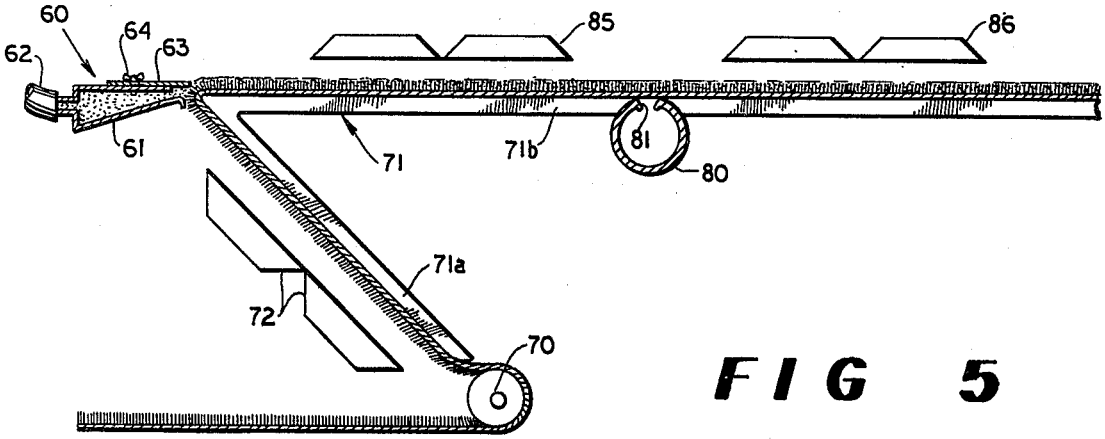
FIG. 5 is a schematic view showing a further embodiment of a carpet dyeing process embodying the principles of the present invention.

FIG. 5 shows a third modification of a foam mixture applicator generally represented by number 60, with applicator 60 being associated with an alternate arrangement of a carpet dyeing process. Applicator 60 is constructed in the form of an extruder 61 extending across the width carpet. Applicator extruder 61 is connected in closed conveying relationship to conduit 62. Conduit 62 is connected to one of the foam machines 14, 15. Applicator extruder 61 is provided with one adjustable wall portion 63 which is held in a selected adjusted position by conventional locking screw means 64. Adjustable wall portion 63 will permit the amount of foam mixture extruded to be varied. Applicator extruder 61 can be supported above carpet 10, as shown in FIG. 1, or can be supported adjacent an angled pile opening portion of carpet 10, as shown in FIG. 5.

The alternate arrangement of the carpet dyeing process shown in FIG. 5 includes means for advancing the carpet around a roller guide 70 and along an upwardly angled path adjacent guide means 71 and beneath pre heat means 72. Guide means 71 includes an upwardly angled portion 71*a* and a horizontal guide portion 71*b* joined to form an apex adjacent applicator extruder 61. As shown in FIG. 5, vacuum conduit means 80 having an elongated slot 81 is supported beneath carpet 10.

Vacuum means 80 can be used to aid in effecting penetration of the foam mixture into the carpet pile. Additional heating means 85, 86 is supported above carpet 10 as it moves along the upper surface of horizontal guide portion 71*b* and prior to movement into the steam oven 30.

Either of the above described applicator means 40, 50 or 60 can be used in a carpet dyeing process embodying the principles of the present invention. In a carpet dyeing process, a first amount of material containing a first carpet dye color is mixed to form one of the batches 17, 21. The batch of material is calculated for the amount of carpet to be dyed. The batch of material is then introduced to one of the foam machines 14, 15 with air being mixed therein to form a foam mixture. The foam mixture is then applied to carpet 10 through one of the applicator means 12, 13 as the carpet is advanced therebeneath. After the foam mixture containing dye has been applied to the carpet, the carpet is then advanced through steam oven 30 for fixation of the dye material to the carpet.

While a first length of carpet is being dyed, a second batch of material containing calculated amounts of water, thickner and another color dye material is mixed to form the second batch. After the first length of carpet is dyed, the first applicator means and foam machine is cleaned. While the first applicator means and foam machine is being cleaned the second batch of material is introduced to the second foam machine, mixed with air to form a foam mixture and then applied to a second length of carpet through the second applicator means.

By using two foam machines and two applicator means, one foam machine and one applicator means can be cleaned while the others are in use. Thus, providing for a continuous carpet dyeing process to obtain maximum utilization of the carpet conveying means, carpet guiding means and the steam oven. The use of the foam mixture containing dye which is applied progressively to only the upper surface of the carpet being advanced along a predetermined path will permit calculated mixture of small amounts of dye material and will provide a carpet dyeing process which can be economically used for dyeing short runs of carpet material.

It now becomes apparent that the above described process and apparatus are capable of obtaining the above stated objects and advantages. It is obvious that those skilled in the art may make modifications in the details of construction without departing from the spirit of the invention which is to be limited only by the scope of the appended claims.

What is claimed is:

1. A process for use in dyeing material, such as carpet, including:

a. advancing a length of material to be dyed along a predetermined path;

b. applying a foam mixture containing dye material to one side of the length of material moving along said predetermined path;

c. applying a vacuum to the side of the length of material opposite to the side thereof to which the foam mixture is applied; and d. fixing said dye material to said length of material.

2. A process as defined in claim 1 further characterized in that said foam mixture containing dye is applied only to the pile or nap surface of a length of carpet material moving along said predetermined path.

3. A process as defined in claim 1 further characterized in that said foam mixture containing dye is applied by extruding said foam mixture onto said length of material.

4. A process as defined in claim 1 further characterized in that said foam mixture containing dye is applied to the upper surface of said length of material moving along said predetermined path in an amount to create a puddle of said foam mixture and wherein said foam mixture is doctored to a predetermined level by an adjustable doctoring blade.

5. A process as defined in claim 4 further characterized in that said doctoring blade includes means for confining the lateral dimensions of said puddle of said foam mixture to the width of said length of material, and wherein said confining means includes a confining element located adjacent each of the lateral side edges of the length of material, with the confining elements being adjustable in a vertical plane.

6. A process as defined in claim 1 further characterized in that said foam mixture containing dye is applied to said length of material in an applicator container, and wherein said applicator container includes a doctoring edge located at a predetermined elevation above said length of material.

7. A process as defined in claim 1 further characterized in that said length of material is advanced in a first direction of movement along said predetermined path and is then angularly adjusted for movement in a second direction along said predetermined path, and wherein said foam mixture is applied to said length of material at said angular change in direction of said length of material moving along said predetermined path.

8. A process as defined in claim 1 further characterized in that said length of material is preheated prior to application of said foam mixture.

9. A process as defined in claim 1 further characterized in that said length of material is heated to a predetermined temperature after application of said foam mixture.

10. A process as defined in claim 1 further characterized in that said foam mixture is made by mixing predetermined amounts of dye material, predetermined amounts of thickening material, predetermined amounts of water, and predetermined amounts of air.

11. A proces as defined in claim 1 further characterized in that said dye is fixed to said length of material by applying a steam heating medium to said length of material containing said foam mixture.

12. A process for use in dyeing material, such as carpet, a selected one of a number of colors including:

a. providing at least two applicator means operable for applying a foam mixture containing dye material;

b. advancing a length of material to be dyed along a predetermined path adjacent said applicator means;

c. operating one of said applicator means a predetermined period of time to apply a foam mixture containing one color of dye to said length of material moving along said predetermined path;

d. fixing said first color dye to said length of material;

e. operating said other one of said applicator means a predetermined period of time to apply a foam mixture containing a second color dye to said length of material moving along said predetermined path; and f. fixing said second color dye to said length of material.

13. A process as defined in claim 12 further characterized in that said foam mixture containing dye is applied only to the pile or nap surface of a length of carpet material moving along said predetermined path.

14. A process as defined in claim 12 further characterized in that said foam mixture containing dye is applied by extruding said foam mixture onto said length of material.

15. A process as defined in claim 12 further characterized in that said foam mixture containing dye is applied to the upper surface of said length of material moving along said predetermined path in an amount to create a puddle of said foam mixture and wherein said foam mixture is doctored to a predetermined level by an adjustable doctoring blade.

16. A process of dyeing material such as carpet comprising the steps of moving a length of material to be dyed along its length in an approximately horizontal attitude through a predetermined path, progressively applying a first foam mixture containing dye to the top surface of the length of material as the length of material moves along the predetermined path, progressively applying a second foam mixture containing a dye to the top surface of the length of material as the length of material moves along the predetermined path after the step of applying the first foam mixture to the length of material has been completed, and progressively fixing the dyes to the length of material as the length of material moves along its path.

17. The process as defined in claim 16 and further characterized in that the foam mixture containing dye is applied to the length of material by extruding the foam mixture onto the length of material.

18. The process as defined in claim 16 and further including the step of heating the foam on the top surface of the length of material.

19. The process as defined in claim 16 and further including the step of preheating the top surface of the material prior to the application of the foam to the material.

* * * * *